United States Patent [19]

Zeilinger et al.

[11] Patent Number: 4,478,648

[45] Date of Patent: Oct. 23, 1984

[54] METHOD OF PRODUCING PROTECTIVE OXIDE LAYERS

[75] Inventors: Hans Zeilinger, Puchheim; August Muhlratzer, Gilching; Bruno Stemmler, Karlsfeld, all of Fed. Rep. of Germany

[73] Assignee: MAN Maschinenfabrik Augsburg-Nurnberg AG, Munich, Fed. Rep. of Germany

[21] Appl. No.: 481,770

[22] Filed: Apr. 4, 1983

[30] Foreign Application Priority Data

Apr. 23, 1982 [DE] Fed. Rep. of Germany ..... 3215314

[51] Int. Cl.[3] ..... C23F 7/02

[52] U.S. Cl. ..... 148/6.3

[58] Field of Search ..... 148/6.3

[56] References Cited

U.S. PATENT DOCUMENTS 2,269,601 1/1942 Perrin ..... 148/6.35
2,784,123 3/1957 Rappaport ..... 148/6.3
3,408,236 10/1968 Hartesvelt ..... 148/6.3
4,263,060 3/1981 Gaucher ..... 148/6.3

FOREIGN PATENT DOCUMENTS 2001677 7/1977 United Kingdom ..... 148/6.35

OTHER PUBLICATIONS

McGannon, The Making & Shaping of Steel, p. 31, 1964.

*Primary Examiner*—Sam Silverberg
*Attorney, Agent, or Firm*—Alan H. Levine

[57] ABSTRACT

A method for producing oxide surface layers on titanium-based objects. The object is pretreated mechanically and, following pretreatment, an oxidation process takes place using a low oxidation potential and a temperature between 480° C. and 800° C. As an oxidizing agent, use is preferably made of water vapor at a partial pressure of about 20 mbar. The water vapor may be mixed with an inert carrier gas, such as argon or helium.

9 Claims, No Drawings

METHOD OF PRODUCING PROTECTIVE OXIDE LAYERS

This invention relates to a method for producing protective oxide surface layers on a metallic component, wherein following a preparatory treatment the object is subjected to an oxidation process at an elevated temperature.

The protective effect of oxide surface layers on metals, against further oxidation or corrosion, is well known. Additionally, natural oxide layers, or oxide layers produced by known processes, may exhibit some inhibiting effect on frictional fusion or seizing, of component surfaces in relative contact in applications where loads are not high and/or where a film of lubricant exists. However, there is no prolonged reliability of dry contact surfaces under high loads, such as high-frequency vibrations. Under these conditions frictional fusion will occur in a short time, and cause the parts to seize. This especially involves mated components of titanium or titanium alloys used in turbines or compressors, the loads being high in these applications.

A known method of protecting titanium parts from frictional fusion is to protect the surface of the object with an oxide layer. According to the known method, a layer of titanium dioxide ($TiO_2$) is provided on the object by heating the object in a pure oxygen atmosphere. However, such a method is not suitable for protecting components in applications wherein they are exposed to extreme loads, perhaps at elevated temperatures, as is the case in compressor and turbine applications. The surface layers produced with the aid of the known method do not exhibit adequate mechanical stability and, thus, offer inadequate resistance to frictional fusion. Under relatively moderate loads, the protective layer chips or, in places, even separates to destroy it completely or render it unserviceable shortly.

In a broad aspect, the present invention improves on the known method such that the oxide layer affords effective protection from frictional fusion of mated components made in whole or in part of titanium.

Copending application Ser. No. 344,349 discloses a method involving subjecting a chromium and/or nickel alloy steel component to prior mechanical or chemical treatment and subsequently performing the oxidation process using a low oxidation potential and a temperature between about 480° and 800° C.

It is a particular object of the present invention to provide a similar method employed with titanium base objects.

Here again the low oxidation potential permits selective oxidation. With the aid of a suitably selected partial pressure of the oxidant, it is possible to cause only single elements, preferably only a single element of the material to be treated, to enter into the oxidation process. Also, a metal able to form various oxides of various valence states can be used to form selected low-valence oxides. In the present case this is $Ti_2O_3$, which is isotopic relative to $Al_2O_3$, the advantageous mechanical properties of which are well known and have given it wide use in wear inhibiting layers deposited by CVD techniques.

A special advantage afforded by the method of the present invention, therefore, is that it produces surface layers composed of a homogeneous mixture of $Ti_2O_3$ and $Al_2O_3$, or $(Ti,Al)_2O_3$. This material is characterized by its high resistance to wear and by its low coefficient of friction. For this reason, and also because the method of the present invention produces uniformly dense layers having improved mechanical stability over the state of the art, these layers offer good protection from frictional welding at elevated temperatures.

The integrity of the protective layer is improved when the object is subjected to preparatory mechanical treatment, such as cold forming.

Mechanical treatment, such as grinding, honing, rolling, or shot peening, preferably assisted by subsequent polishing, can operate jointly with subsequent heat treatment to give a finer grain on the surface of the object. This increases the mobility of the alloying atoms, which will foster the insertion of the aluminum minority component into the oxide. Additionally, the bond is improved. This explains the good mechanical stability, when viewed in light of the $(Ti,Al)_2O_3$ formation caused by the low oxidation potential, where owing to its low diffusion rate the $(Ti,Al)_2O_3$ grows slowly but densely in its crystal lattice.

As an oxidant for the oxidation process, use can be made of $CO_2$. This will enable the auxiliary equilibrium $2CO_2=2CO_2+O_2$ to be utilized for reducing the partial oxygen pressure.

A preferred oxidant to use is water vapor. Using water vapor, the oxidation potential to be achieved under the auxiliary equilibrium $2H_2O=2H_2+O_2$ can still be lower than that in the case of $CO_2$. The hydrogen being released during oxidation will even benefit the process, the hydrogen further reducing the partial oxygen pressure at the phase boundary.

In order to prevent the oxidation process from taking place under reduced pressure, and to avoid the use of vacuum equipment, the oxidant is passed over the object to be coated in an inert carrier gas, preferably some rare gas, such as helium or argon. The oxidant can then be routed preferably through a closed-loop circuit or through a partially closed or open mode.

When $CO_2$ is used as an oxidant, an oxidation potential under 50 mbar is used, preferably about 10 mbar, whereas the partial water vapor pressure is less than 100 mbar, these values being referred to standard conditions. A special advantage will be provided by carrying out the oxidation process under water vapor at a partial pressure of about 20 mbar. These conditions can be achieved directly at atmospheric pressure at room temperature.

An advantage will be afforded when the thickness of oxide layer runs between 10 μm and 15 μm. A layer of this description will resist mechanical stresses, and other loads, well and therefore be stable.

EXAMPLE

For coating titanium-base alloy TiAl16V4, the following process operations were made:

(a) The surface was first prepared mechanically by grinding (320 mesh), honing, or shot peening and polished on its mating surfaces with other components;

(b) The oxidation process was then started at 800° C. at a water vapor pressure of 20 mbar in argon;

(c) After 4 hours of oxidation, a dense $(Ti,Al)_2O_3$ layer 10 to 15 μm thick was obtained.

This invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A method of producing a protective oxide layer on an object made of a titanium alloy, comprising the steps of:

pretreating the surface of the object, thereafter oxidizing the surface of the object by heating it at a temperature in the range between about 500° and 900° C. in the presence of a gaseous mixture including an oxidizing agent, selected from the group consisting of water vapor and carbon dioxide, mixed with an inert carrier gas, the oxidizing being carried out without reducing the pressure of the gaseous mixture below atmospheric, and adjusting the oxidation potential of the oxidizing agent so as to selectively oxidize only the titanium constituent of the alloy to form the low valence oxide $Ti_2O_3$.

2. A method as defined in claim 1 wherein the mechanical pretreatment is cold forming.

3. A method as defined in claim 1 wherein the oxidation potential of the oxidizing agent is adjusted by varying the partial pressure of the oxidizing agent.

4. A method as defined in claim 2 wherein the $CO_2$ partial pressure, with respect to standard conditions, being less than 50 mbar.

5. A method as defined in claim 4 wherein the $CO_2$ partial pressure, with respect to standard conditions, being about 10 mbar.

6. A method as defined in claim 1 wherein the oxidation step lasts for 4 hours and takes place at 800° C. using 20 mbar water vapor carried by a rare gas.

7. A method as defined in claim 1 wherein the water vapor partial pressure, with respect to standard conditions, is less than 100 mbar.

8. A method as defined in claim 7 wherein the water vapor partial pressure, with respect to standard conditions, is about 20 mbar.

9. A method as defined in claim 1 wherein the inert gas is a rare gas, such as argon or helium.

* * * * *